US008439157B2

(12) United States Patent
Sugiyama et al.

(10) Patent No.: US 8,439,157 B2
(45) Date of Patent: May 14, 2013

(54) ENGINE

(75) Inventors: Masaki Sugiyama, Numazu (JP); Tetsuya Hasegawa, Numazu (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 13/275,732

(22) Filed: Oct. 18, 2011

(65) Prior Publication Data

US 2012/0103720 A1 May 3, 2012

(30) Foreign Application Priority Data

Oct. 29, 2010 (JP) ..... 2010-244751

(51) Int. Cl.
*F01N 13/10* (2010.01)

(52) U.S. Cl.
USPC ..... 181/240; 181/212; 138/109

(58) Field of Classification Search ..... 181/240, 181/212; 138/109
See application file for complete search history.

(56) References Cited

U.S. PATENT DOCUMENTS

| | | | | |
|---|---|---|---|---|
| 5,359,159 | A * | 10/1994 | Gommel | 181/230 |
| 6,422,338 | B1 * | 7/2002 | Menzel et al. | 181/230 |
| 6,955,043 | B2 * | 10/2005 | Schlossarczyk et al. | 60/299 |
| 7,896,127 | B2 * | 3/2011 | Sato et al. | 181/240 |
| 2009/0038879 | A1 | 2/2009 | Sato et al. | |
| 2010/0083512 | A1 * | 4/2010 | Shimokawa et al. | 30/381 |
| 2011/0017336 | A1 * | 1/2011 | Drew et al. | 138/109 |

FOREIGN PATENT DOCUMENTS

| | | | |
|---|---|---|---|
| CN | 2309427 | Y | 3/1999 |
| CN | 2011447 | Y | 11/2008 |
| FR | 2 708 043 | A1 | 1/1995 |
| JP | A-2007-2730 | | 1/2007 |
| WO | WO 2011/011260 | A1 | 1/2011 |

OTHER PUBLICATIONS

European Search Report dated Dec. 14, 2011 in European Patent Application No. 11 186 000.3.

* cited by examiner

*Primary Examiner* — Forrest M Phillips
(74) *Attorney, Agent, or Firm* — Oliff & Berridge, PLC

(57) ABSTRACT

An object of the present invention is to provide a muffler mounting structure configured to be able to prevent fastening parts from slackening by reducing the thermal conductivity from an exhaust port to the muffler mounting bosses and an engine including the muffler mounting structure. An engine of the present invention 100 includes a cylinder block 101 or the cylinder head 10 constitutes a combustion chamber 105 with a piston 104, an exhaust port configured to communicate with the combustion chamber, and a muffler mounted to an outlet of the exhaust port, wherein the muffler is mounted with a muffler mounting boss into which a fixing part is fitted, and the muffler mounting boss is connected to a fin formed in the cylinder.

9 Claims, 9 Drawing Sheets

ENGINE

BACKGROUND

1. Field of the Invention

The present invention relates to an engine, and more particularly, relates to an engine configured to be able to prevent muffler mounting bolts to fix a muffler to an engine body, from slackening.

2. Description of the Related Art

Conventionally, as a muffler mounting structure for fixing a muffler to the engine body, a structure in which a muffler is fixed to the engine body with bolts, is generally known.

In a muffler mounting structure disclosed, for example, in Japanese Patent Application Laid-Open No. 2007-2730, fastening parts are fitted into muffler mounting bosses, and they are fixed with a fixing member placed on them to mount the muffler to the engine body.

In the muffler mounting structure of the engine described in the above-mentioned patent document, those muffler mounting bosses are provided nearby an exhaust port.

Accordingly, there is a technical problem that the muffler mounting bosses tend to increase in the temperature, and therefore the fastening parts fitted into the muffler mounting bosses slacken by thermal expansion of the muffler mounting bosses.

SUMMARY

In view of the above-described problems, an object of the present invention is to provide an engine configured to be able to prevent fastening parts from slackening by reducing the thermal conductivity from a combustion chamber and an exhaust port to the muffler mounting bosses.

An engine of the present invention includes a cylinder constituting a combustion chamber with a piston, an exhaust port configured to communicate with the combustion chamber, and a muffler mounted to an outlet of the exhaust port. The muffler is mounted with a muffler mounting boss into which a fixing part is fitted, and the muffler mounting boss is connected to a fin formed in the cylinder.

The fin of the engine serves as a cooling fin for the cylinder.

In the engine, a plurality of fins are formed in the cylinder, and the muffler mounting boss bridges between the plurality of fins.

In the engine, the fin serves as a bearing surface to which the muffler is attached.

The engine further includes a cooling fan configured to send cooling air. The muffler mounting boss includes a first muffler mounting boss and a second mounting boss, the first muffler mounting boss is positioned in a more upstream side of the cooling air than the exhaust port, and the second muffler mounting boss is positioned in a more downstream side of the cooling air than the exhaust port, and the first muffler mounting boss is connected directly to the cylinder, and the second muffler mounting boss is connected to the cylinder via the fin.

The engine further includes a cooling fan configured to send cooling air. The muffler mounting boss includes a first muffler mounting boss and a second muffler mounting boss, the first muffler mounting boss is positioned in a more upstream side of the cooling air than the exhaust port, and the second muffler mounting boss is positioned in a more downstream side of the cooling air than the exhaust port, and a distance between the second muffler mounting boss and the cylinder is greater than a distance between the first muffler mounting boss and the cylinder.

In the engine, the cylinder is configured to be able to be separated into a cylinder head and a cylinder block.

With the engine according to the present invention, the muffler mounting bosses are connected to the cylinder via the fins, and therefore the thermal conductivity from the combustion chamber and the exhaust port to the muffler mounting bosses can be reduced. By this means, it is possible to prevent the fastening parts fitted into the muffler mounting bosses from slackening.

In addition, with the engine according to the present invention, the plurality of fins are disposed in the cylinder, and the muffler mounting bosses bridge between the plurality of fins, and therefore are supported by the plurality of fins. As a result, the rigidity of the muffler mounting bosses can be improved. By this means, it is possible to prevent the muffler mounting bosses from being damaged.

Moreover, with the engine according to the present invention, the fin serves as a bearing surface to which the muffler is attached, and therefore the muffler can be mounted without a separate seat plate. Hence, the number of parts can be reduced.

Furthermore, with the engine according to the present invention, the first muffler mounting boss is connected directly to the cylinder, and the second muffler mounting boss is connected to the cylinder via the cooling fin which is cooled by cooling air where the first muffler mounting boss is positioned in the more upstream side of the cooling air than the exhaust port, and the second muffler mounting boss is positioned in the more downstream side of the cooling air than the exhaust port. As a result, the cooling efficiency of the second muffler mounting boss is improved. Therefore, the difference in temperature between the first muffler mounting boss and the second muffler mounting boss can be reduced. By this means, it is possible to equalize the thermal expansion rate of the fastening part fitted into the first muffler mounting boss and the thermal expansion rate of the fastening part fitted into the second muffler mounting boss. Therefore, it is possible to prevent the fastening parts from slackening.

Furthermore, with the engine according to the present invention, the first muffler mounting boss and the second muffler mounting boss bridge between the plurality of fins which serve as cooling fins to cool the cylinder. Hence, the first muffler mounting boss and the second muffler mounting boss are cooled by the cooling air flowing through the plurality of cooling fins. In addition, the distance between the second muffler mounting boss and the cylinder is greater than the distance between the first muffler mounting boss and the cylinder. Therefore, in particular, cooling air flows smoothly around the second muffler mounting boss which tends to rise in temperature, so that the cooling efficiency is improved. Therefore, the difference in temperature between the first muffler mounting boss and the second muffler mounting boss can be reduced. By this means, it is possible to equalize the thermal expansion rate of the fastening part fitted into the first muffler mounting boss and the thermal expansion rate of the fastening part fitted into the second muffler mounting boss. Therefore, it is possible to prevent the fastening parts from slackening.

DETAILED DESCRIPTION

Embodiment 1

Figure 1:
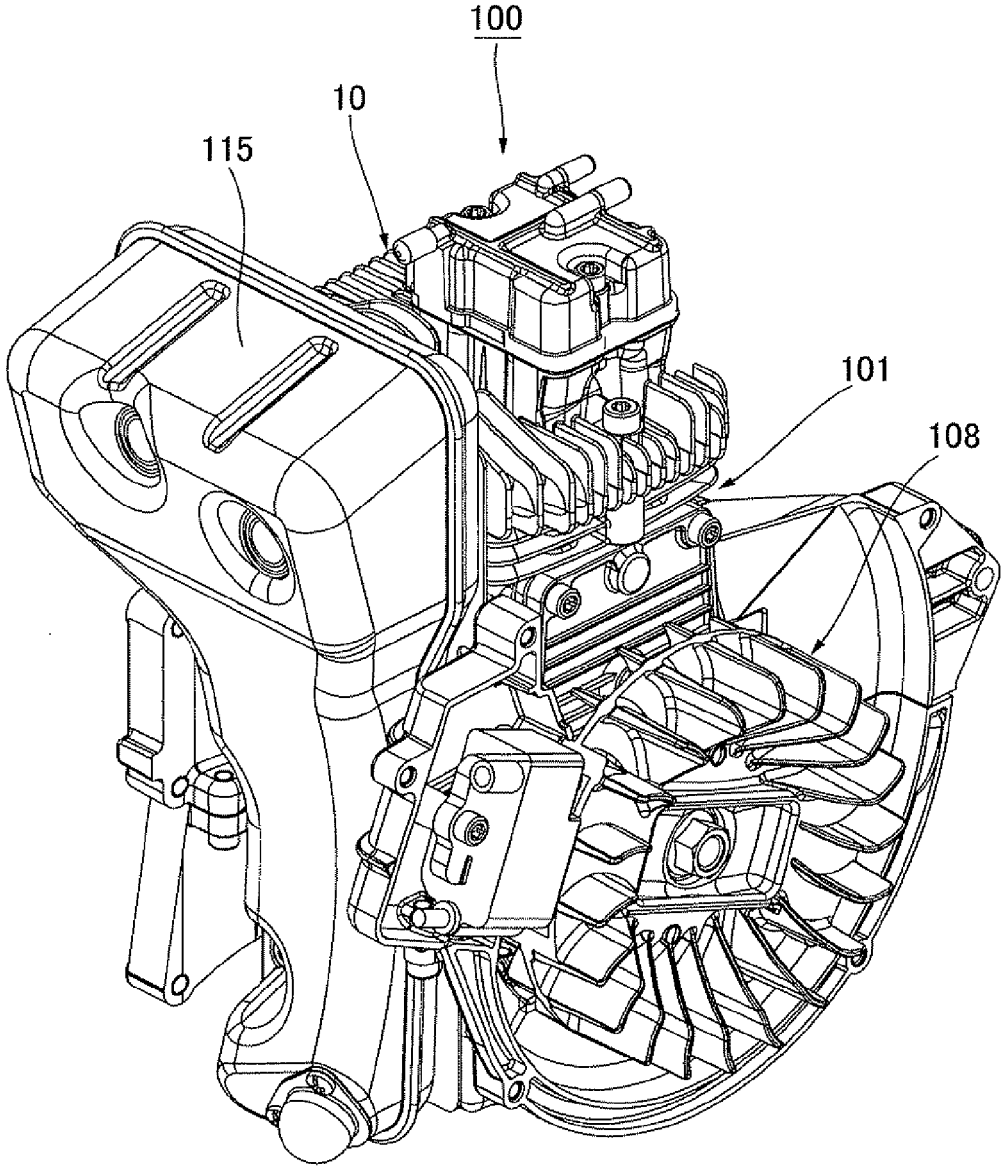
FIG. 1 is a perspective view schematically showing the configuration of an engine according to one embodiment of the present invention.
Figure 2:
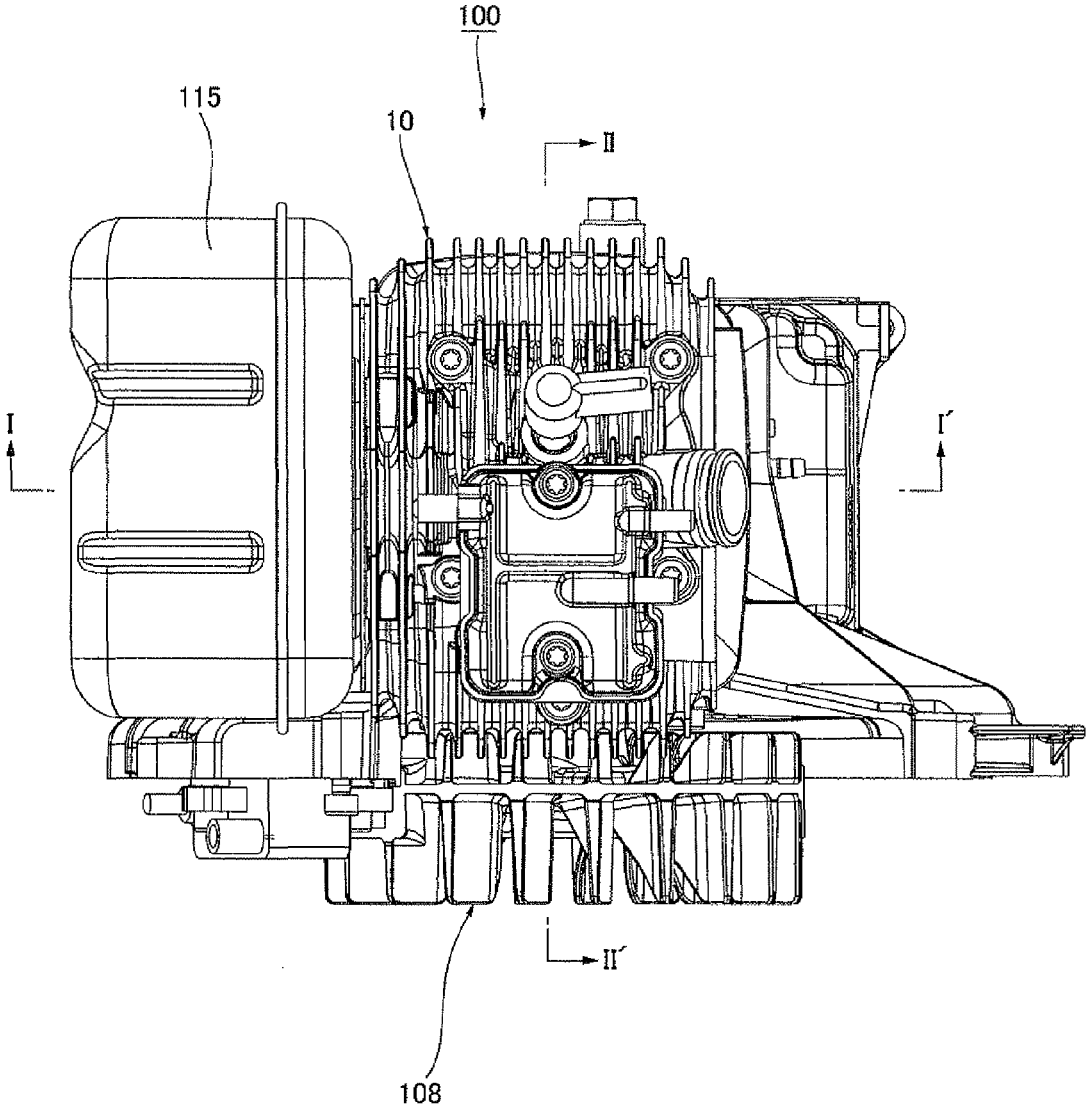
FIG. 2 is a plan view schematically showing the configuration of the engine according to one embodiment of the present invention.
Figure 3:
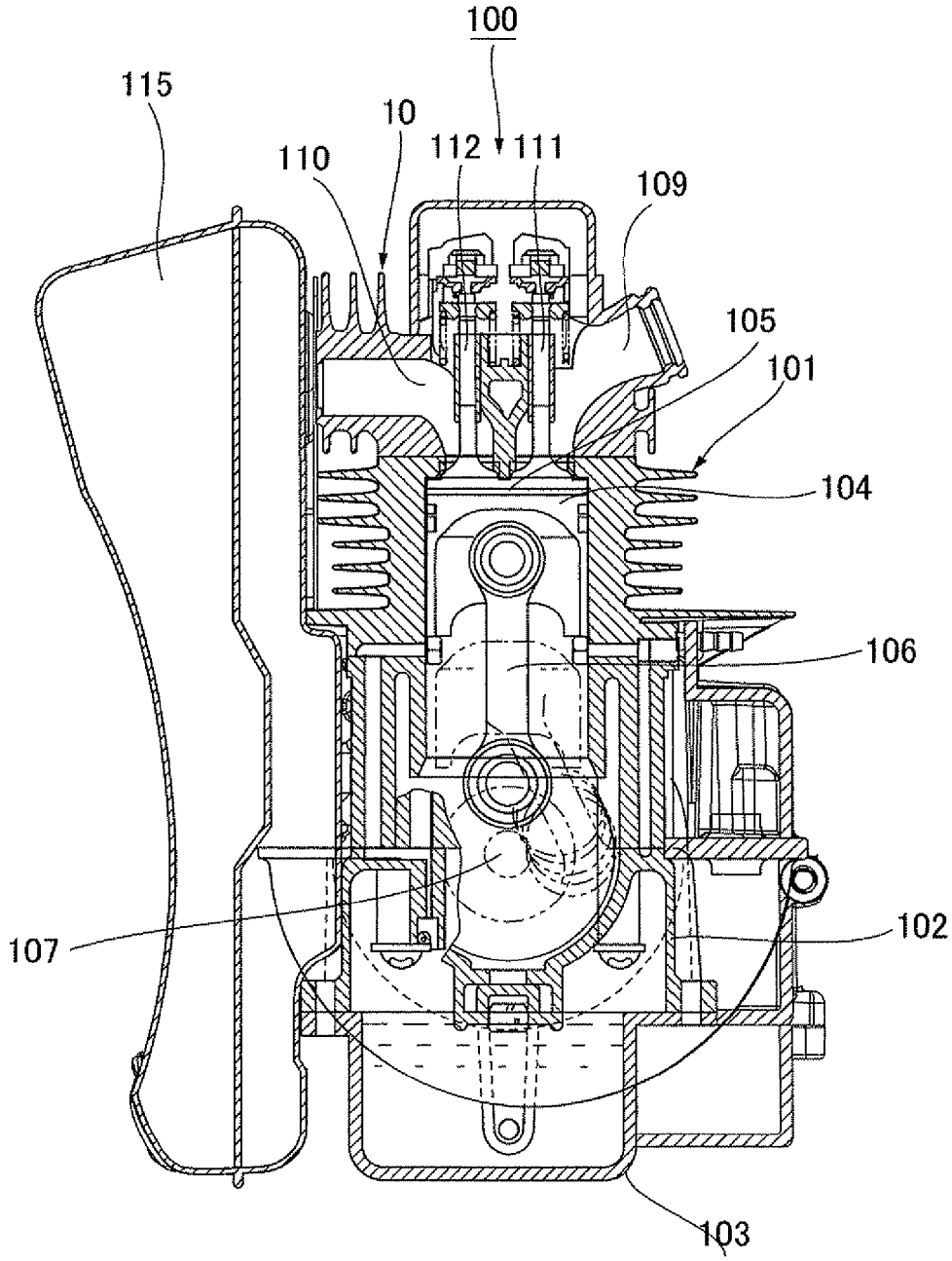
FIG. 3 schematically shows a cross section taken along line I-I' in FIG. 2.
Figure 4:
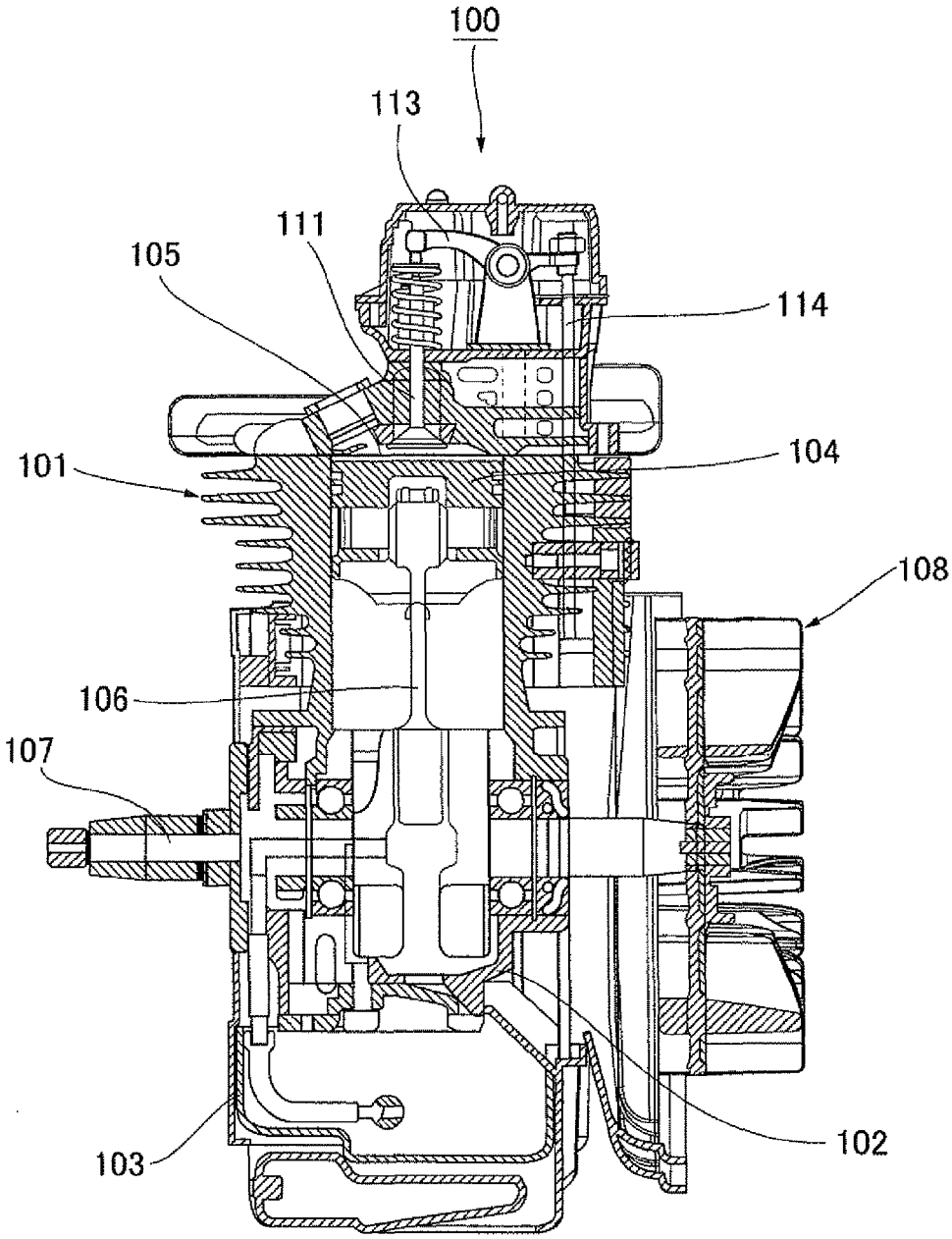
FIG. 4 schematically shows a cross section taken along line II-II' in FIG. 2.

FIG. 1 is a perspective view schematically showing the configuration of an engine 100 according to one embodiment of the present invention. FIG. 2 is a plan view schematically showing the configuration of the engine 100 according to one embodiment of the present invention. FIG. 3 schematically shows a cross section taken along line I-I' in FIG. 2. FIG. 4 schematically shows a cross section taken along line II-II' in FIG. 2.

As shown in FIG. 1 to FIG. 4, an engine 100 of the present embodiment mainly includes a cylinder block 101, a crankcase 102, an oil case 103, and a cylinder head 10. These components are detachably mounted by coupling with each other with bolts.

Note that, in the engine 100 of the present embodiment, the cylinder block 101 and the cylinder head 10 are separated from one another to help to achieve high output, and an exhaust port 110 (described later) is provided in the cylinder head 10.

The main body of the engine 100 is formed by the cylinder block 101, the crankcase 102, the oil case 103, and the cylinder head 10. A piston 104 is inserted in the cylinder block 101 to reciprocably move.

The piston 104 can reciprocate in the cylinder block 101 by explosive power generated due to the combustion of mixed air in the combustion chamber 105 described later. A connecting rod 106 is pivotably connected to the piston 104.

The connecting rod 106 converts the reciprocating motion of the piston 104 in the cylinder block 101 into the rotating motion of a crank shaft 107 described later. One end of the connecting rod 106 is connected pivotably to the piston 104. The other end of the connecting rod 106 is connected to a crank shaft 107.

As described above, the crank shaft 107 is connected to the piston 104 via the connecting rod 106. Accordingly, the reciprocating motion of the piston 104 is converted into the rotating motion of the crank shaft 107 via the connecting rod 106, and then transmitted to an output shaft.

The crank shaft 107 is rotatably supported by the cylinder block 101 and the crankcase 102 which is provided on one end side (the lower side in FIG. 3) in the longitudinal direction of the cylinder block 101.

Specifically, a crank chamber is formed in the crankcase 102. Both ends of the crank shaft 107 projecting from the crank chamber are sandwiched and rotatably supported between the cylinder block 101 and the crankcase 102.

In addition to the output shaft, the cylinder block 101 constituting the main body of the engine 100 and a cooling fan 108 for sending cooling air to the cylinder head 10, are connected to the crank shaft 107.

That is, the cooling fan 108 rotates in conjunction with the rotation of the crank shaft 107, and sends cooling air in the radial direction and the axial direction of the crank shaft 107. In other words, the cooling fan 108 sends cooling air to the cylinder block 101 and the cylinder head 10 constituting the main body of the engine 100.

In addition, the oil case 103 to store oil to be supplied to the crank chamber, is provided in the other end side of the crankcase 102 (the lower side in FIG. 1 to FIG. 4). The oil case 103 is formed as a housing which is surrounded on all four sides and the bottom and has an opening on the top.

The inside of the oil case 103 surrounded on all four sides and the bottom serves as an oil reservoir. The semicircular portion of the crankcase 102 accommodating the crank shaft 107 where the crank shaft 107 can rotate, serves as a partition between the crank chamber and the oil reservoir.

On the other hand, the cylinder head 10 is provided on the other end side of the cylinder block 101 (the upper part in FIG. 1). The cylinder block 101, the upper surface of the piston 104 and the cylinder head 10 form a combustion chamber 105. An intake port 109 is formed on the cylinder head 10. The intake port 109 communicates with a carburetor (not shown).

An exhaust port 110 is formed on the cylinder head 10. The exhaust port 110 is in communication with a muffler 115. An intake valve 111 which opens and closes the intake port 109, is provided on the intake port 109. Additionally, an exhaust valve 112 which opens and closes the exhaust port 110 is provided on the exhaust port 110.

The intake valve 111 opens in an intake stroke over which the piston 104 moves from the top dead center to the bottom dead center. In the intake stroke, mixed air from the intake port 109 is mixed in the combustion chamber 105 due to the effect of the negative pressure generated by increasing the volume of the combustion chamber 105.

Additionally, the exhaust valve 112 opens during an exhaust stroke over which the piston 104 moves from the bottom dead center to the top dead center. In the exhaust stroke, exhaust gas generated in the combustion chamber 105 is discharged from the exhaust port 110 to the muffler 115, due to the effect of the positive pressure generated by reducing the volume of the combustion chamber 105.

A valve operating mechanism is connected to the intake valve 111 and the exhaust valve 112, which drives the intake valve 111 and the exhaust valve 112 to open and close the intake port 109 and the exhaust port 110. This valve operating mechanism is a so-called OHV type valve operating mechanism.

Specifically, the valve operating mechanism mainly includes a crank shaft gear, a cam shaft and a rocker arm 113. These crank shaft gear and cam shaft are provided in a side chamber which is formed along the cylinder block 101 and the crankcase 102. Meanwhile, the rocker arm 113 is provided in a valve operating chamber which is formed in the cylinder head 10.

The crank shaft gear is disposed in the side chamber to rotate together with the crank shaft 107. The cam shaft gear is provided in the cam shaft. The cam shaft gear meshes with the crank shaft gear in the side chamber, and rotates the cam shaft with rotation which is half of the rotation of the crank shaft 107.

Moreover, a cam is provided on the cam shaft. The cam rotates together with the cam shaft. The one end of a push rod 114 contacts the cam, and the push rod 114 moves in the longitudinal direction along with the rotation of the cam.

Meanwhile, the other end of the push rod 114 is connected to the rocker arm 113, and the rocker arm 113 swings with the movement of the push rod 114. Then, the intake valve 111 and the exhaust valve 112 reciprocate along with the swing of the rocker arm 113. This allows the intake port 109 and the exhaust port 110 to open and close.

As described above, with the present embodiment, the exhaust port 110 is formed on the cylinder head 10, and exhaust gas generated from the exhaust port 110 is discharged from the cylinder head 10 to the muffler 115.

In the present embodiment, the muffler 115 is attached to the cylinder head 10 on which the exhaust port 110 opens. In this case, the muffler 115 is mounted by fitting fastening parts (not shown) into a first muffler mounting boss 16 and a second muffler mounting boss 17 which are muffler mounting bosses described later.

Next, the cylinder head 10 will be explained with reference to FIG. 5 to FIG. 8. The cylinder head 10 is a main component of the muffler mounting structure for mounting the muffler 115 to the engine 100 according to the present embodiment.

Figure 5:
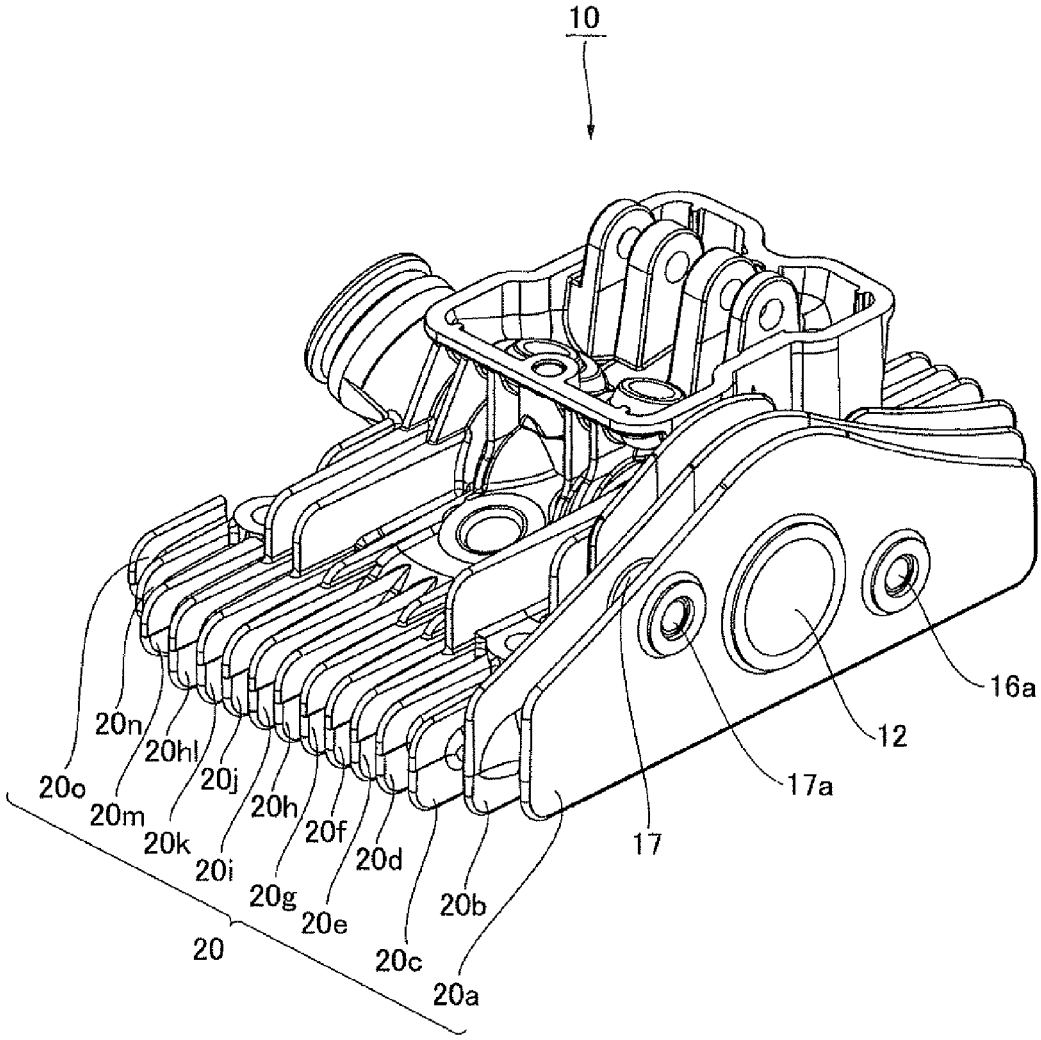
FIG. 5 is a perspective view schematically showing the configuration of a cylinder head of the engine according to one embodiment of the present invention.
Figure 6:
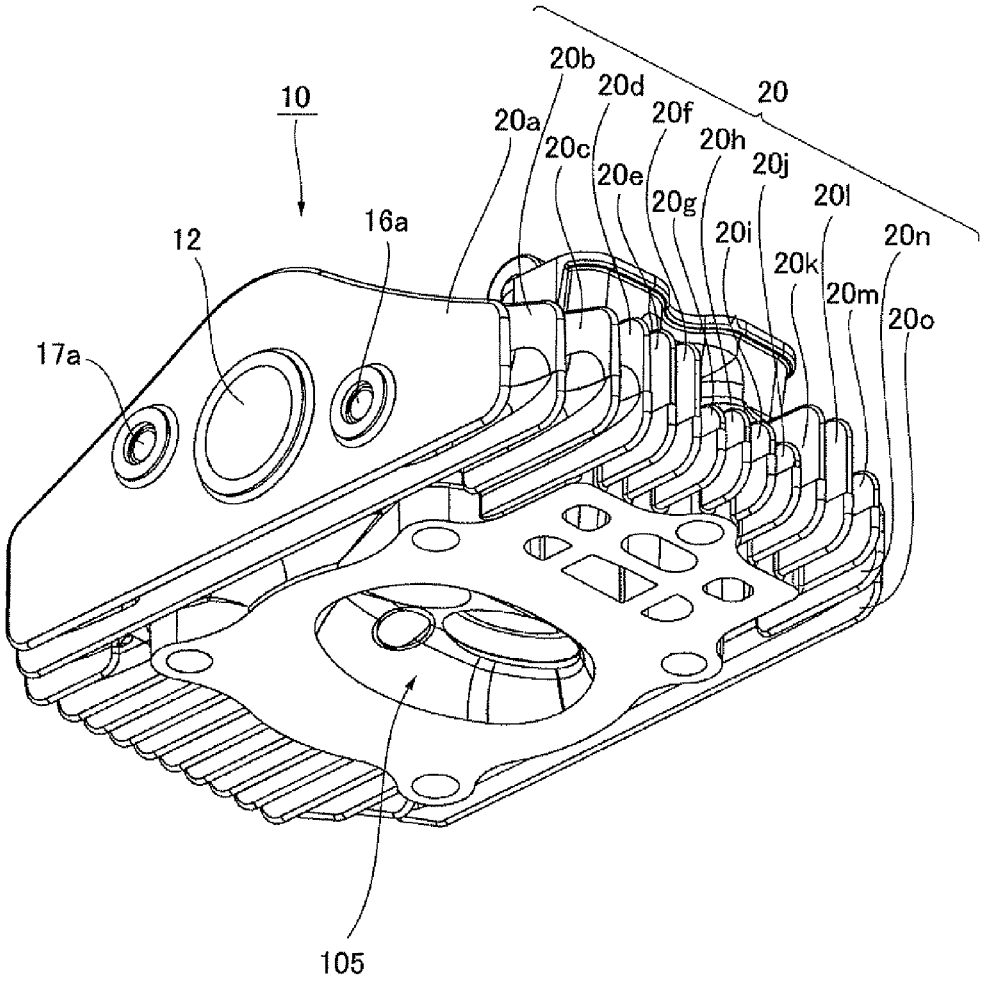
FIG. 6 is a perspective view schematically showing the configuration of the cylinder head of the engine according to one embodiment of the present invention.
Figure 7:
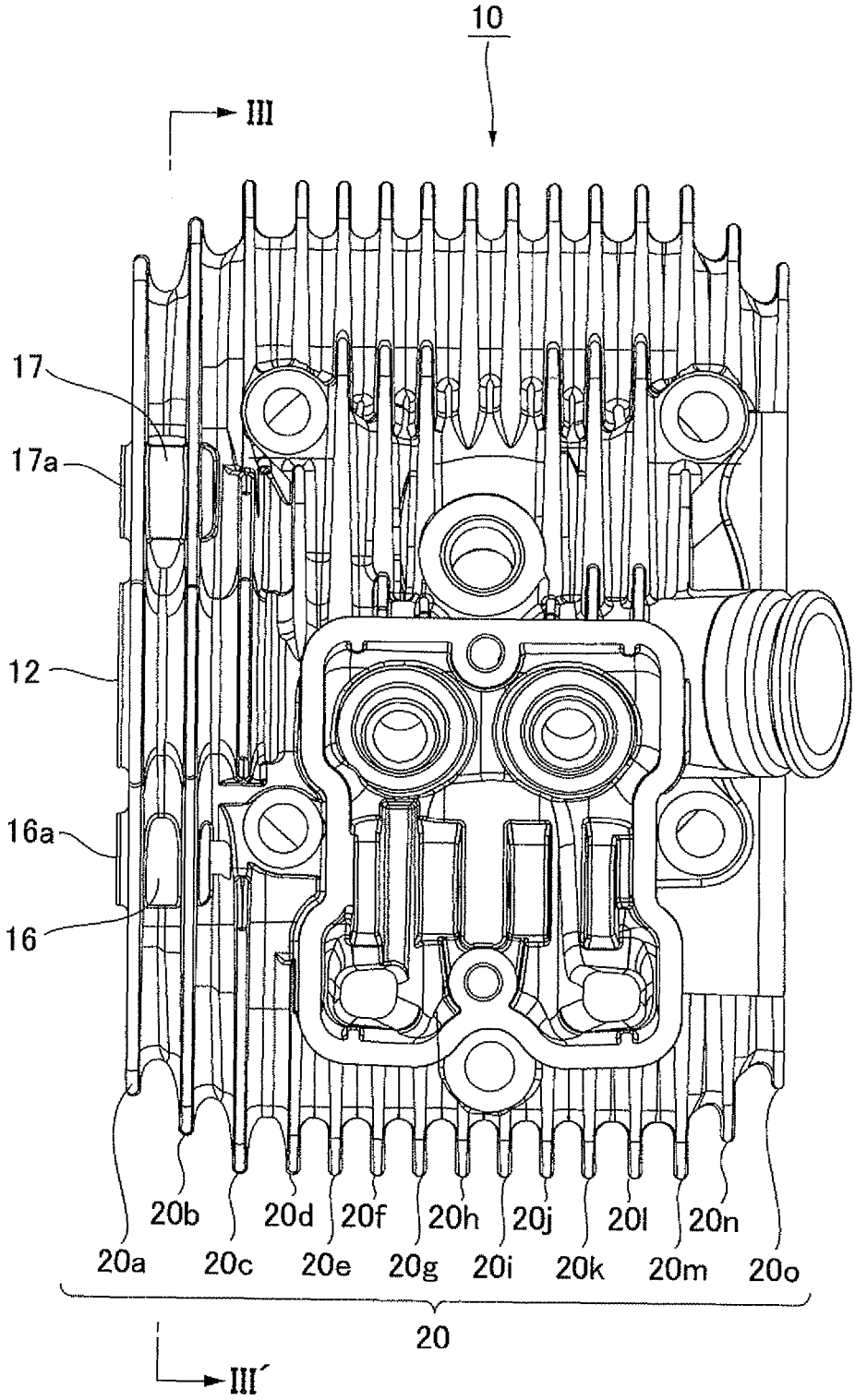
FIG. 7 is a plan view schematically showing the configuration of the cylinder head of the engine according to one embodiment of the present invention.
Figure 8:
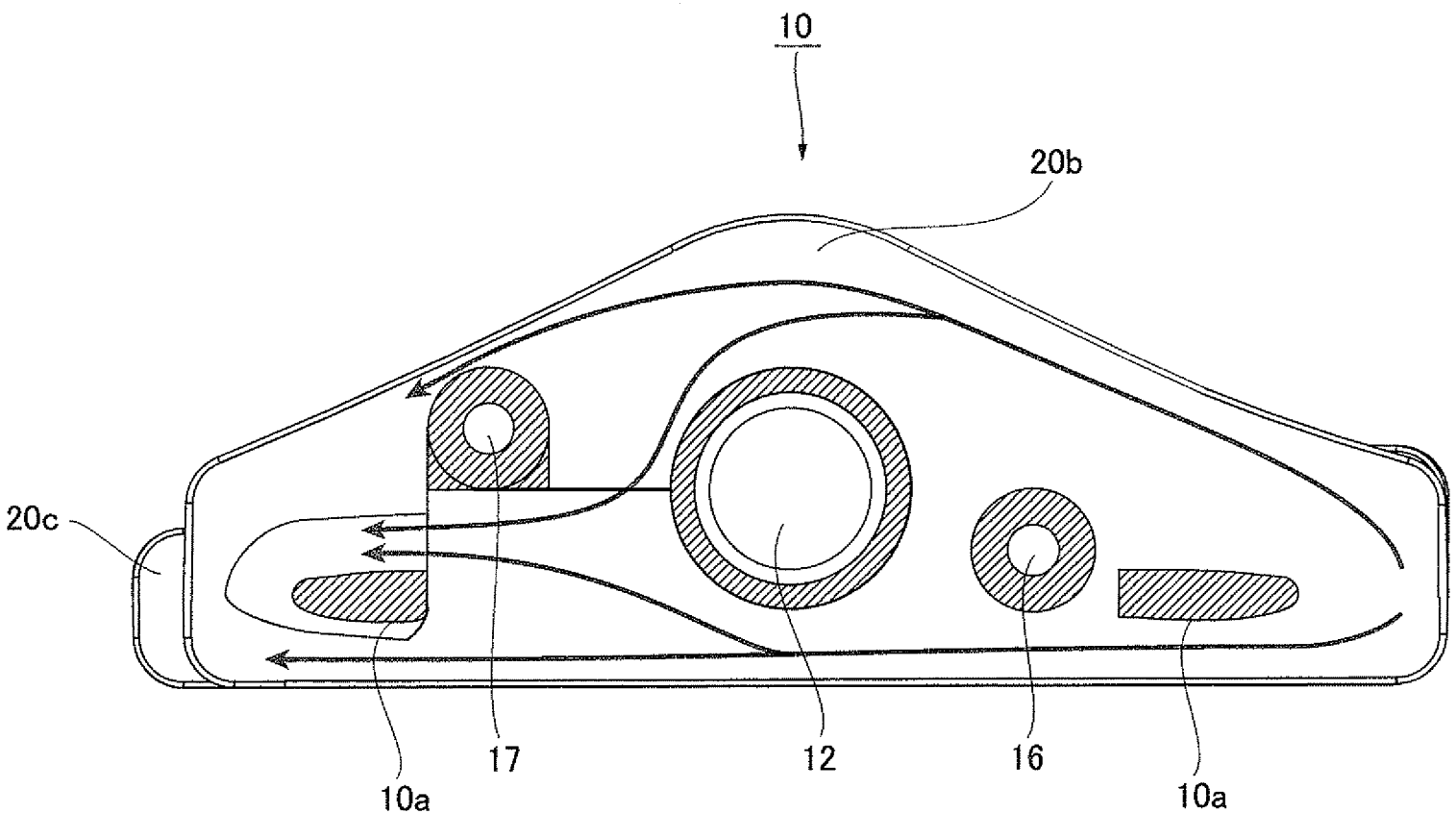
FIG. 8 schematically shows a cross section taken along line III-III' in FIG. 7.

FIG. 5 is a perspective view schematically showing from above the configuration of the cylinder head 10 of the engine 100 according to one embodiment of the present invention. FIG. 6 is a perspective view schematically showing from below the configuration of the cylinder head 10 of the engine 100 according to one embodiment of the present invention. FIG. 7 is a plan view schematically showing from above the configuration of the cylinder head 10 of the engine 100 according to one embodiment of the present invention. FIG. 8 schematically shows a cross section taken along line III-III' in FIG. 7. Here, the arrows shown in FIG. 8 illustrate the flows of cooling air send by the cooling fan 108.

As shown in FIG. 5 to FIG. 8, the intake port 109 is formed on the cylinder head 10. The intake port 109 is disposed in communication with the combustion chamber 105 as described above, and sucks in from the carburetor (not shown) to the combustion chamber 105.

In addition, the exhaust port 110 is formed on the cylinder head 10. The exhaust port 110 is disposed in communication with the combustion chamber 105 as described above, and discharges the exhaust gas generated in the combustion chamber 105 to the muffler 115.

A plurality of fins 20 are formed on the cylinder head 10. These fins 20 are disposed so as to cover the intake port 109 and the exhaust port 110, and send cooling air from the cooling fan 108 to the neighborhood of the intake port 109 and the exhaust port 110.

These fins 20 stand in the same direction and are spaced from and parallel to each other. That is, the cooling air from the cooling fan 108 can cool the intake port 109 and the exhaust port 110 by flowing through the plurality of fins 20.

In the present embodiment, an exhaust opening 12 of the exhaust port 110 is formed on the outermost fin 20*a* among the plurality of fins 20. The opening of the first muffler mounting boss 16 and the opening of the second muffler mounting boss 17 are formed on the fin 20*a*. The fastening parts to mount the muffler are fitted into the first muffler mounting boss 16 and the second muffler mounting boss 17.

The fin 20*a* includes the opening of the first muffler mounting boss 16, the opening of the second muffler mounting boss 17, and the exhaust opening 12 on the same plane, and serves as a bearing surface to which the muffler is attached.

In this way, the outermost fin 20*a* serves as a bearing surface to which the muffler is attached, and therefore there is no need to separately form a bearing surface on a place in the main body of the engine 100. Hence, it is possible to simplify the configuration of the mold for the main body of the engine 100. Moreover, the number of parts can be reduced because there is no need to separately form a bearing surface on a place in the main body of the engine 100.

The first muffler mounting boss 16, the second muffler mounting boss 17, and the exhaust opening 12 of the exhaust port 110 slightly protrude from the surface of the fin 20*a*. By this means, it is possible to form a small gap between the bearing surface of the muffler and the fin 20*a* when the muffler is mounted. Therefore, it is possible to reduce the thermal conductivity from the muffler to the first muffler mounting boss 16 and the second muffler mounting boss 17.

As described above, the exhaust port 110 of the present embodiment bridges between the outermost fin 20*a* and a fin 20*b* which is next to the fin 20*a* and penetrate the fin 20*a* and the fin 20*b*.

Also, the first muffler mounting boss 16 and the second muffler mounting boss 17 bridge between the outermost fin 20*a* and the fin 20*b* which is next to the fin 20*a*. That is, the exhaust port 110, the first muffler mounting boss 16 and the second muffler mounting boss 17 bridge between the fin 20*a* and the fin 20*b* and are arranged in parallel with each other.

In this way, the first muffler mounting boss 16 and the second muffler mounting boss 17 bridge between the fin 20*a* and the fin 20*b*. Therefore, it is possible to improve the rigidity of the first muffler mounting boss 16 and the second muffler mounting boss 17.

In the present embodiment, the first muffler mounting boss 16 is positioned in the more upstream side of cooling air than the exhaust port 110. Meanwhile, the second muffler mounting boss 17 is positioned in the more downstream side of cooling air than the exhaust port 110.

Here, the cooling air sent from the cooling fan 108 flows into the space between the fin 20*a* and the fin 20*b*, and passes through the neighborhood of the first muffler mounting boss 16 to cool the first muffler mounting boss 16.

Then, the cooling air passes around the exhaust port 110 to cool the exhaust port 110. At this time, heat is generated because the cooling air passes around the exhaust port 110, and this heat increases the temperature of the cooling air.

Then, the cooling air whose temperature having increased passes through the neighborhood of the second muffler mounting boss 17 to cool the second muffler mounting boss 17. By this means, the first muffler mounting boss 16 and the second muffler mounting boss 17 are different in cooling efficiency with the cooling air from the cooling fan 108.

In this way, taking into account the first muffler mounting boss 16 and the second muffler mounting boss 17 are different in cooling efficiency, the distance between the second muffler mounting boss 17, and a base part 10*a* of the cylinder head 10 and the exhaust port 110 is greater than the distance between the first muffler mounting boss 16 and those.

Accordingly, it is possible to make the thermal conductivity from the base part 10*a* of the cylinder head 10 and the exhaust port 110 to the second muffler mounting boss 17 lower than the thermal conductivity from the base part 10*a* of the cylinder head 10 and the exhaust port 110 to the first muffler mounting boss 16 to improve the cooling efficiency of the second muffler mounting boss 17. Therefore, it is possible to prevent the fastening parts fitted into the second muffler boss 17 from slackening.

Although the first muffler mounting boss 16 and the second muffler mounting boss 17 are different in cooling efficiency with the cooling air from the cooling fan 108, the distance between the second muffler mounting boss 17 and the base part 10*a* of the cylinder head 10 is greater than the distance between the first muffler mounting boss 16 and the base part 10*a* of the cylinder head 10. Therefore, the thermal conductivity from the combustion chamber 105 and the exhaust port 110 to the second muffler mounting boss is reduced. As a result of this, it is possible to reduce the difference in temperature between the first muffler mounting boss 16 and the second muffler mounting boss 17.

As described above, with the present embodiment, the thermal conductivity from the combustion chamber 105 and the exhaust port 110 to the second muffler mounting boss 17 can be reduced. Also, the difference in temperature between the first muffler mounting boss 16 and the second muffler mounting boss 17 can be reduced. Therefore, it is possible to prevent the fastening parts from slackening.

Embodiment 2

Figure 9:
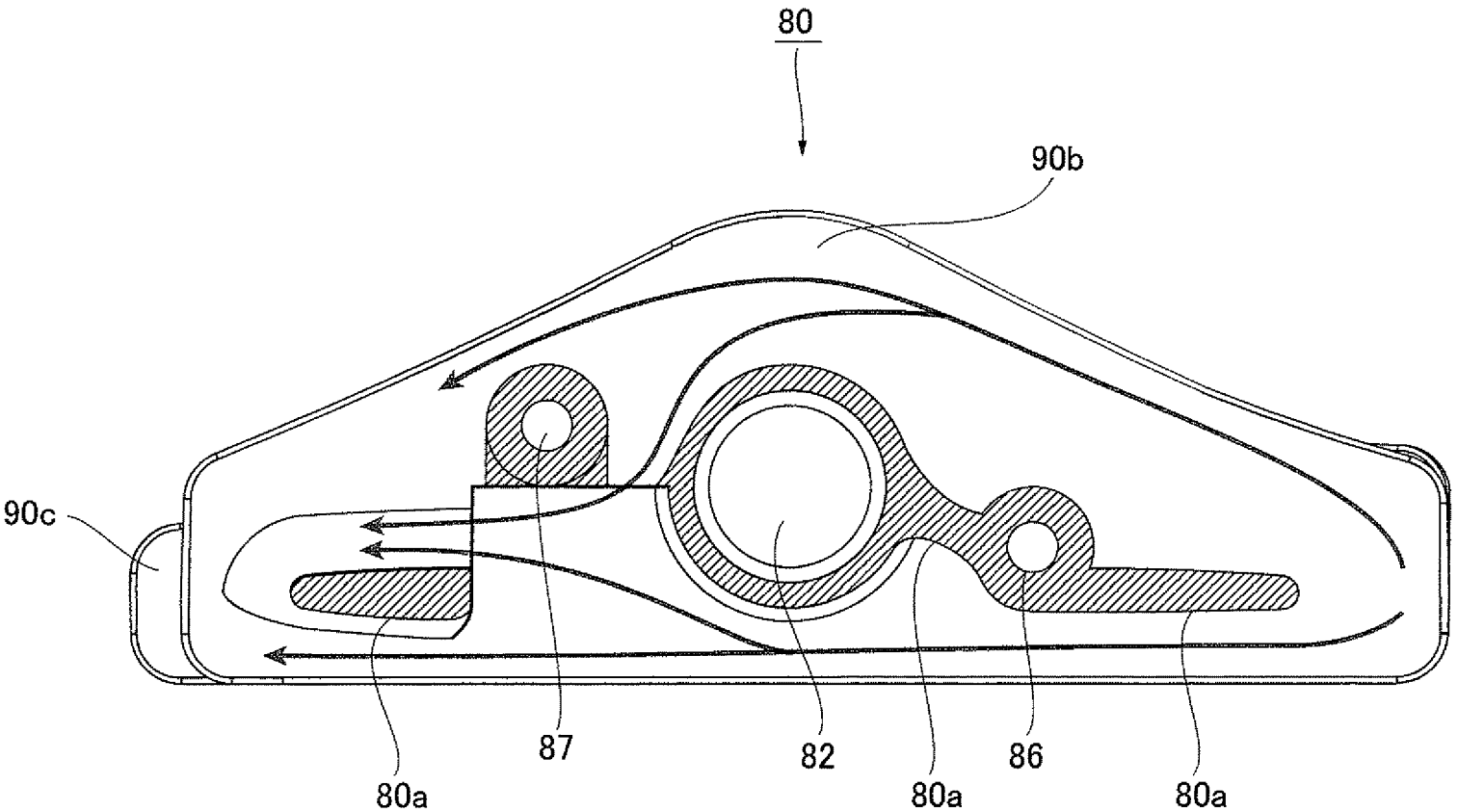
FIG. 9 is a cross-sectional view schematically showing the cylinder head of the engine according to another embodiment of the present invention, taken along the line III-III' in FIG. 7.

Next, the engine of the second embodiment will be described with reference to FIG. 9. FIG. 9 is a cross-sectional view schematically showing the configuration of the cylinder head 80 of the engine according to another embodiment of the present invention, taken along line III-III' in FIG. 7.

Here, the engine of the second embodiment is different from the engine of the above-described first embodiment in that, a first muffler mounting boss 86 is connected directly to a base part 80*a* of a cylinder head 80, and a second muffler mounting boss 87 is connected to the base part 80*a* of the cylinder head 80 via a fin 90*a*. The other components are the same as in the engine of the first embodiment. The same or equivalent components as in the first embodiment are assigned the same reference numerals, and overlapping descriptions will be omitted.

As shown in FIG. 9, in the cylinder head 80 of the present embodiment, the first muffler mounting boss 86 is connected directly to the base part 80*a* of the cylinder head 80, and the second muffler mounting boss 87 is connected to the base part 80*a* of the cylinder head 80 via the fin 90*a*, as described above.

Therefore, it is possible to reduce the difference in temperature between the first muffler mounting boss 86 and the second muffler mounting boss 87 where the first muffler mounting boss 86 is positioned in the more upstream side of cooling air than the exhaust port 110 and the second muffler mounting boss 87 is positioned in the more downstream side of cooling air than the exhaust port 110. By this means, it is possible to equalize the thermal expansion rate of the fastening part fitted into the first muffler mounting boss 86 and the thermal expansion rate of the fastening part fitted into the second muffler mounting boss 87 to prevent the fastening parts from slackening.

As described above, the engine 100 of the present embodiment has high output where the cylinder block 101 and the cylinder head 10 are separated from one another to help to achieve high output. This high-output engine 100 tends to increase in temperature at the combustion chamber 105 and the exhaust port 110. Therefore, the cooling efficiency with the present invention is especially effective for the engine 100.

The engine 100 of the present embodiment is not limited to a configuration with high output where the cylinder block 101 and the cylinder head 10 are separated from one another, but another configuration is possible to produce the same effect where the cylinder block 101 and the cylinder head 10 are integrally formed.

In addition, although the engine 100 of the present embodiment is a four-stroke engine here, the present invention is not limited to this, and, even when applied to a two-stroke engine, it is possible to produce the same effect, as long as the muffler mounting bosses to mount the muffler 115 to the main body of the engine 100 are apart from the exhaust port and there is a distance between the exhaust port and the muffler mounting bosses.

The invention claimed is:

1. An engine comprising:

a cylinder constituting a combustion chamber with a piston;

an exhaust port configured to communicate with the combustion chamber;

a muffler mounted to an outlet of the exhaust port;

a fin formed in the cylinder; and an opening formed in the fin, wherein the muffler is mounted with a muffler mounting boss into which a fixing part is fitted; and the muffler mounting boss is connected to the fin and disposed in the opening of the fin.

2. The engine according to claim 1, wherein the fin serves as a cooling fin for the cylinder.

3. The engine according to claim 2, wherein a plurality of fins are formed in the cylinder, and the muffler mounting boss bridges between the plurality of fins.

4. The engine according to claim 3, wherein the fin serves as a bearing surface to which the muffler is attached.

5. The engine according to claim 1, wherein the fin serves as a bearing surface to which the muffler is attached.

6. The engine according to claims 3, further comprising a cooling fan configured to send cooling air, wherein:

the muffler mounting boss includes a first muffler mounting boss and a second mounting boss, the first muffler mounting boss being positioned in a more upstream side of the cooling air than the exhaust port, and the second muffler mounting boss being positioned in a more downstream side of the cooling air than the exhaust port; and the first muffler mounting boss is connected directly to the cylinder, and the second muffler mounting boss is connected to the cylinder via the fin.

7. The engine according to claim 2, further comprising a cooling fan configured to send cooling air, wherein:

the muffler mounting boss includes a first muffler mounting boss and a second mounting boss, the first muffler mounting boss being positioned in a more upstream side of the cooling air than the exhaust port, and the second muffler mounting boss being positioned in a more downstream side of the cooling air than the exhaust port; and the first muffler mounting boss is connected directly to the cylinder, and the second muffler mounting boss is connected to the cylinder via the fin.

8. The engine according to claim 3, further comprising a cooling fan configured to send cooling air, wherein:

the muffler mounting boss includes a first muffler mounting boss and a second muffler mounting boss, the first muffler mounting boss being positioned in a more upstream side of the cooling air than the exhaust port, and the second muffler mounting boss being positioned in a more downstream side of the cooling air than the exhaust port; and a distance between the second muffler mounting boss and the cylinder is greater than a distance between the first muffler mounting boss and the cylinder.

9. The engine according to claim 1, wherein the cylinder is configured to be able to be separated into a cylinder head and a cylinder block.

* * * * *